US012704319B2

(12) United States Patent
Bhavsar et al.

(10) Patent No.: US 12,704,319 B2
(45) Date of Patent: Aug. 11, 2026

(54) REFRIGERATOR AND STORAGE SYSTEM FOR A REFRIGERATOR

(71) Applicant: WHIRLPOOL CORPORATION, Benton Harbor, MI (US)

(72) Inventors: Yogeshkumar G. Bhavsar, Pune (IN); Chad Rotter, Saugatuck, MI (US); Lalit Madhukar Suryawanshi, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 69 days.

(21) Appl. No.: 18/806,328

(22) Filed: Aug. 15, 2024

(65) Prior Publication Data

US 2026/0049756 A1 Feb. 19, 2026

(51) Int. Cl.

| | |
|---|---|
| ***F25D 23/06*** | (2006.01) |
| ***A47B 88/427*** | (2017.01) |
| ***F25D 25/02*** | (2006.01) |

(52) U.S. Cl.

CPC ..... *F25D 23/067* (2013.01); *A47B 88/427* (2017.01); *F25D 25/025* (2013.01); *F25D 2400/18* (2013.01)

(58) Field of Classification Search

CPC . A47B 88/423; A47B 88/427; A47B 88/0418; A47B 88/0422; A47B 2088/4272; A47B 2088/4274; A47B 2088/4276; A47B 2088/4278; A47B 2088/0425; A47B 2088/0429; A47B 2088/0433; A47B 2088/0437; F25D 2325/00; F25D 23/067; F25D 25/025; F25D 2400/18

See application file for complete search history.

(56) References Cited

U.S. PATENT DOCUMENTS

| | | | | |
|---|---|---|---|---|
| 6,637,848 | B2 * | 10/2003 | Lin | A47B 88/427 312/334.26 |
| 8,220,285 | B2 * | 7/2012 | Park | F25D 25/025 62/340 |
| 9,046,295 | B2 * | 6/2015 | Han | H01R 25/006 |
| 2007/0138804 | A1 * | 6/2007 | Koloff | F25D 25/025 292/204 |
| 2008/0203875 | A1 * | 8/2008 | Lim | F25D 23/021 312/404 |

FOREIGN PATENT DOCUMENTS

| | | | | |
|---|---|---|---|---|
| CN | 201503184 U | * | 6/2010 | |
| CN | 108286865 A | * | 7/2018 | F25D 25/025 |
| CN | 108720379 A | * | 11/2018 | A47B 88/423 |

(Continued)

*Primary Examiner* — Andrew Roersma

(74) *Attorney, Agent, or Firm* — Brooks Kushman P.C.

(57) ABSTRACT

A refrigerator appliance includes a cabinet, a storage bin, a guide, and a cover. The cabinet defines an internal cavity. The storage bin is disposed within the internal cavity. The guide movably secures the storage bin to the cabinet such that the storage bin is movable into and out of the internal cavity via the guide. The cover is operable to conceal the guide. The cover is secured to the storage bin. The cover is secured to the guide such that the storage bin is secured to the guide via the cover. The cover has a protrusion extending laterally inward therefrom. The protrusion engages the storage bin to restrict lateral movement of the storage bin.

20 Claims, 5 Drawing Sheets

(56) References Cited

FOREIGN PATENT DOCUMENTS

| | | | | | |
|---|---|---|---|---|---|
| DE | 3011271 | A1 | * | 10/1981 | |
| DE | 29923509 | U1 | * | 11/2000 | ..... A47B 67/04 |
| DE | 102007051343 | A1 | * | 4/2009 | ..... A47B 88/427 |
| DE | 102016219885 | A1 | * | 4/2018 | ..... F25D 25/025 |
| JP | 4283291 | B2 | * | 6/2009 | ..... F25D 25/025 |
| KR | 1020100013084 | A | * | 2/2010 | ..... F25D 23/067 |
| KR | 1020210157588 | A | * | 12/2021 | ..... F25D 25/025 |
| WO | WO-2013031149 | A2 | * | 3/2013 | ..... F25D 25/025 |

* cited by examiner

REFRIGERATOR AND STORAGE SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes a cabinet, a storage bin, guides, and guide covers. The cabinet defines an internal cavity. The storage bin is disposed within the internal cavity. The storage bin has side walls. The storage bin has overhanging regions extending laterally outward from the side walls along a top and a front of the storage bin. The storage bin defines spaces between the side walls and the overhanging regions. The guides each have first and second rails slidably secured to each other. The first rail of each guide is secured to the cabinet. The guide covers are each operable to conceal one of the guides. The guide covers are each disposed within one of the spaces such that the guide covers are concealed by the overhanging regions. The guide covers are each secured to an internal side of one of the overhanging regions along the front of storage bin. The guide covers are each secured to one of the second rails such that the storage bin is secured to each of the second rails via the guide covers, and such that the storage bin is operably slidable into and out of the internal cavity via relative movement between the first and second rails.

A refrigerator appliance includes a cabinet, a storage bin, a guide, and a cover. The cabinet defines an internal cavity. The storage bin is disposed within the internal cavity. The guide movably secures the storage bin to the cabinet such that the storage bin is movable into and out of the internal cavity via the guide. The cover is operable to conceal the guide. The cover is secured to the storage bin. The cover is secured to the guide such that the storage bin is secured to the guide via the cover. The cover has a protrusion extending laterally inward therefrom. The protrusion engages the storage bin to restrict lateral movement of the storage bin.

A refrigerator appliance includes a cabinet, a storage bin, a guide rail, and an adapter plate. The cabinet defines an internal cavity. The storage bin is disposed within the internal cavity. The storage bin has an overhanging region extending laterally outward from a lateral side of the storage bin along a top and a front of the storage bin. The storage bin defines a space between the lateral side and the overhanging region. The guide rail movably secures the storage bin to the cabinet such that the storage bin is movable into the internal cavity via the guide rail. The adapter plate is disposed within the space such that the adapter plate is concealed by the overhanging region. The adapter plate is secured to an internal side of the overhanging region. The adapter plate is secured to the guide rail such that storage bin is secured to guide rail via the adapter plate. The adapter plate has a protrusion extending laterally inward therefrom. The protrusion engages the storage bin to restrict lateral movement of the storage bin.

DETAILED DESCRIPTION

Figure 1:
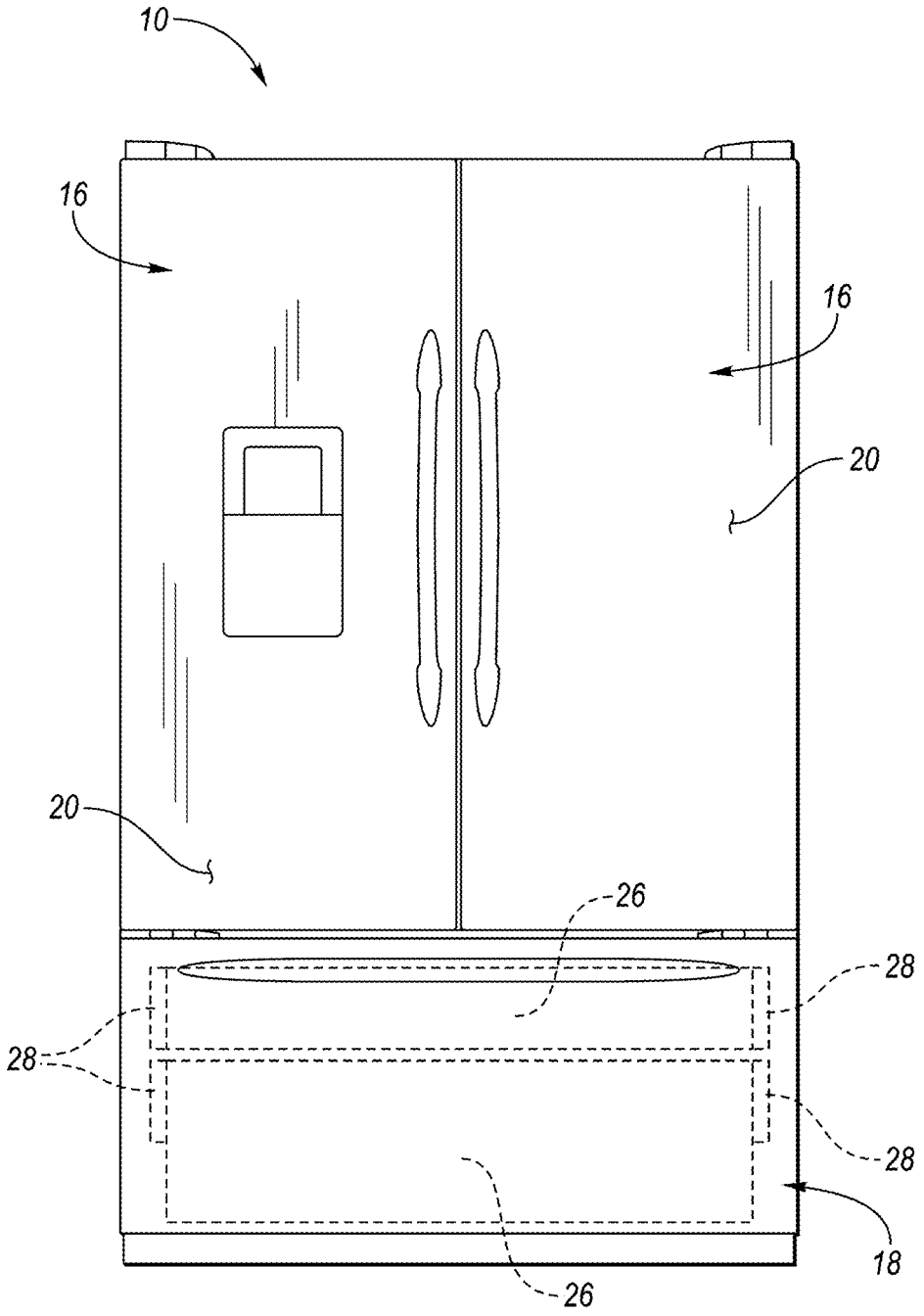
FIG. 1 is an elevated front view of a French-Door Bottom Mount type refrigerator appliance.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within +0%, 0.1%, 0.5%, 1%, 2%, 3%, 4%, 5% or 10% of the value or relative characteristic.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 2:
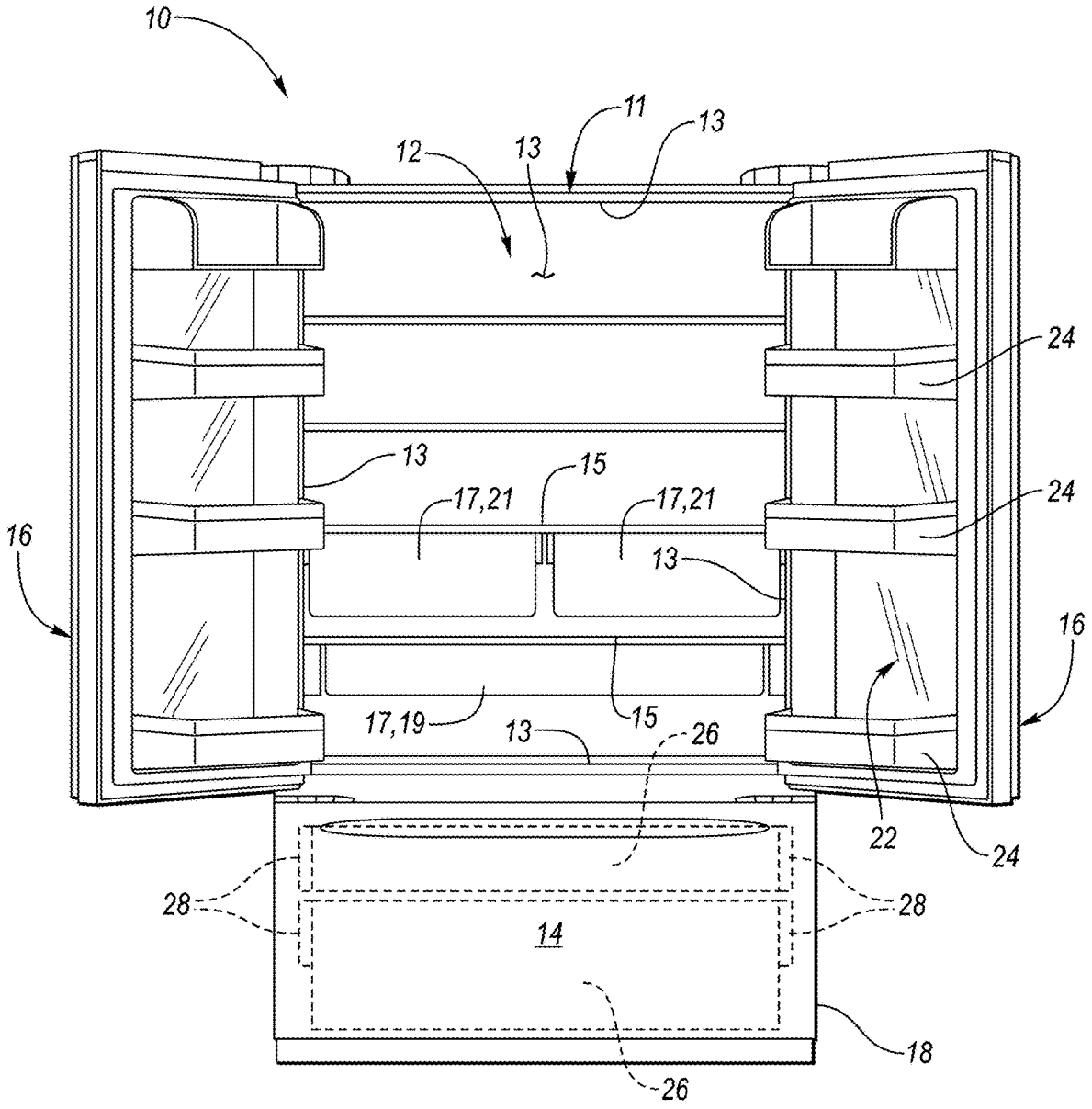
FIG. 2 is an elevated front view of a French-Door Bottom Mount type refrigerator with the refrigerator compartment doors open.
Figure 3:
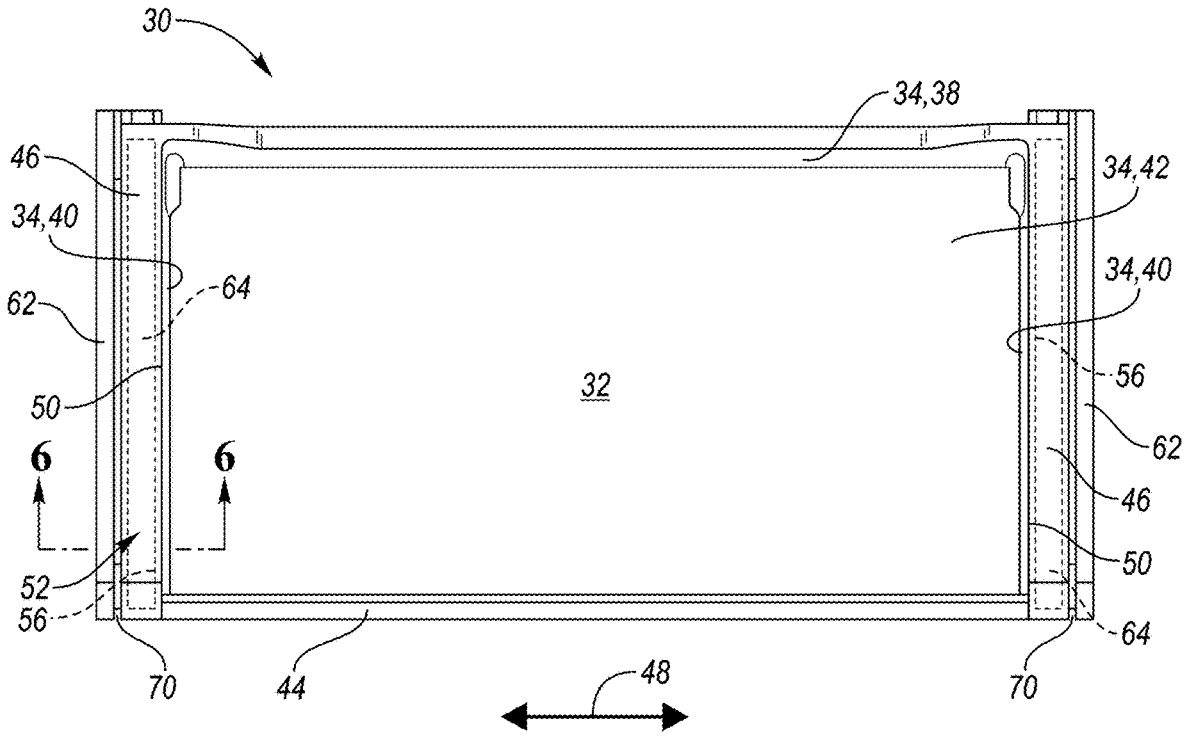
FIG. 3 is a plan view of a of storage bin that is disposed within one of the compartments of the refrigerator.
Figure 4:
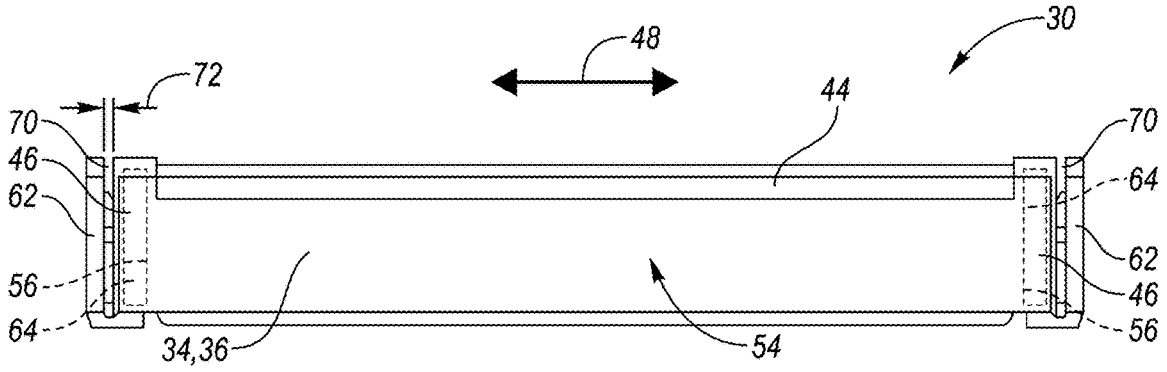
FIG. 4 is a front view of the storage bin.
Figure 5:
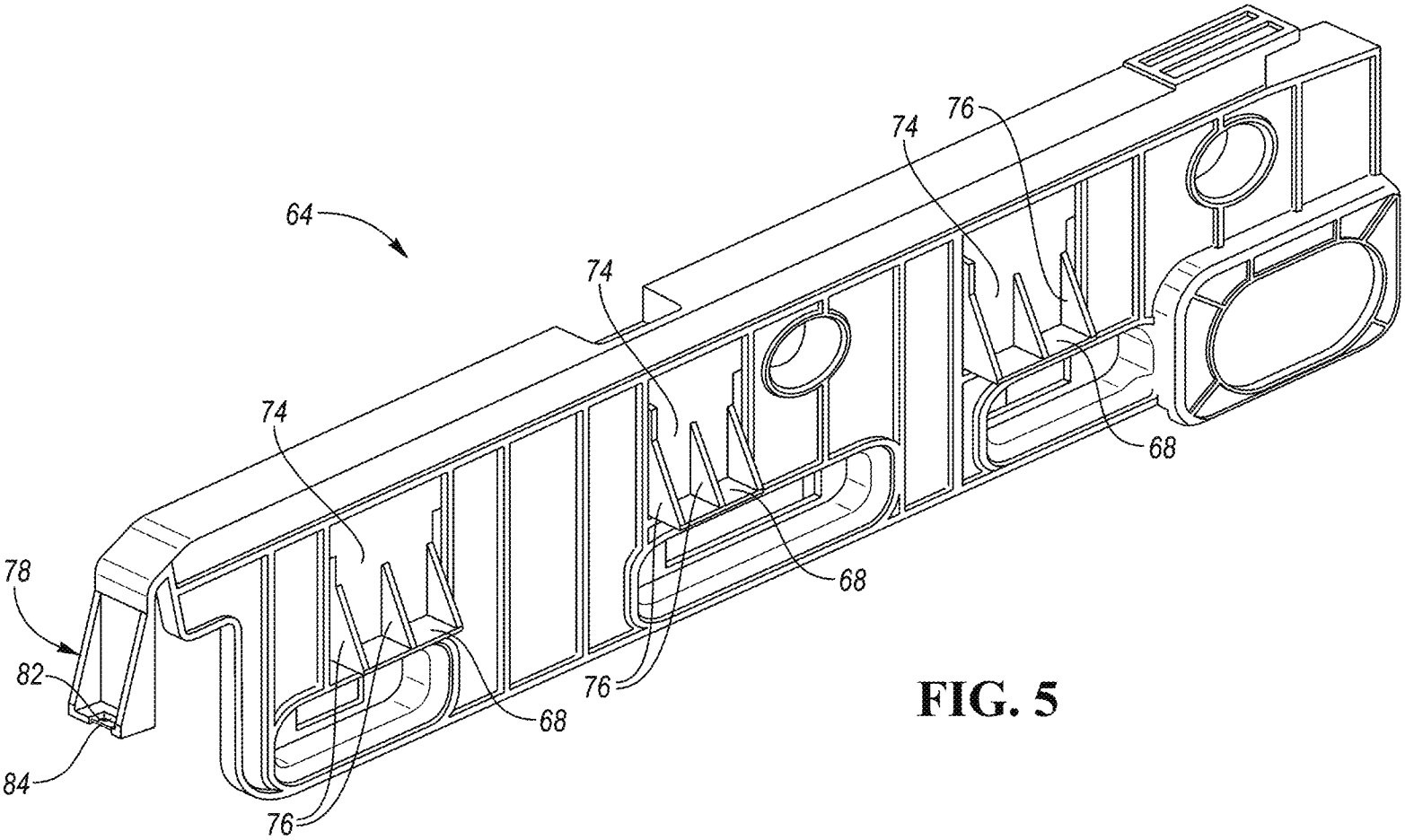
FIG. 5 is a perspective view of a guide cover that secures to the storage bin to guides.
Figure 7:
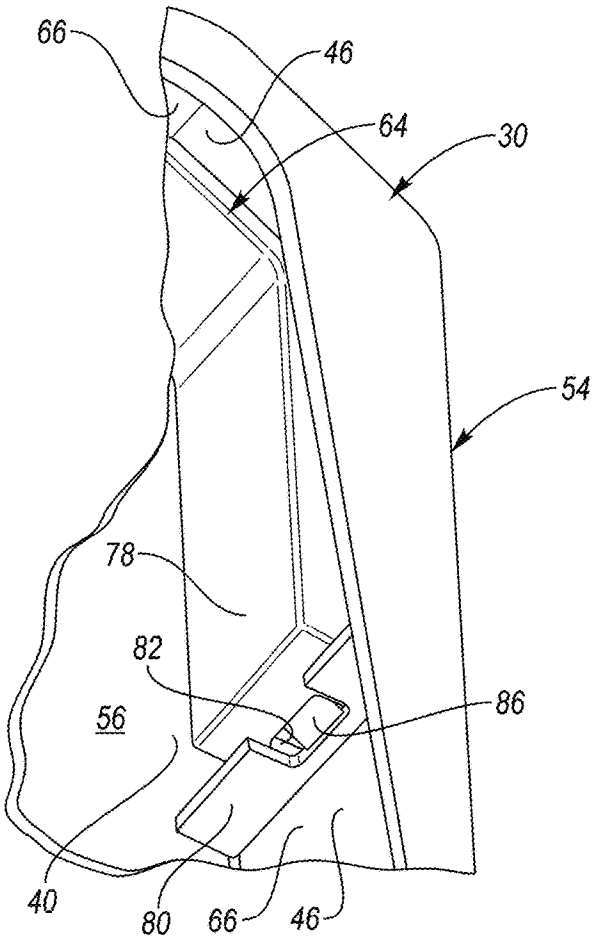
FIG. 7 is a partial lower perspective view illustrating a connection between the guide cover and the storage bin.
Figure 6:
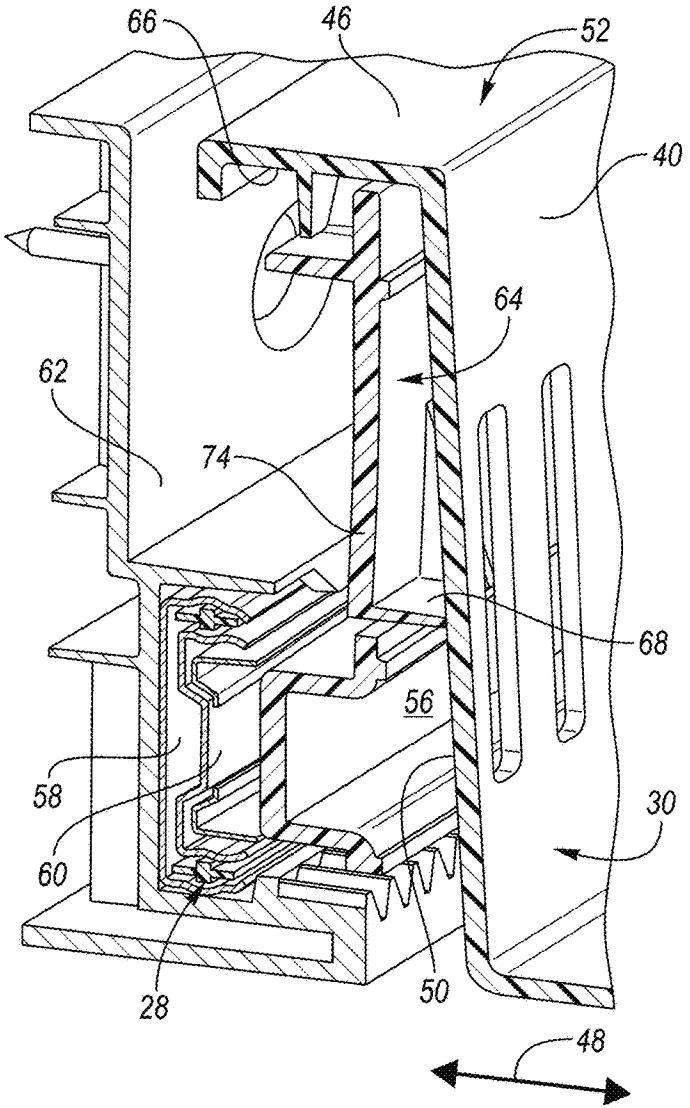
FIG. 6 is a cross-sectional view taken along line 6-6 in FIG. 3.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal refrigerated storage chamber, first internal refrigerated cavity, or fresh food compartment 12 configured to refrigerate and not freeze consumables within the fresh food compartment 12, and a second internal refrigerated storage chamber, second internal refrigerated cavity, or a freezer compartment 14 configured to freeze consumables within the freezer compartment 14 during normal use. The refrigerator 10 includes panels or walls 13 that form a cabinet 11 or housing. The cabinet 11, or more specifically the walls 13, may define the fresh food compartment 12 and the freezer compartment 14. The walls 13 may form an internal liner of the refrigerator 10, or more specifically an internal liner of the cabinet 11. The walls 13 may include a rear or back wall, a top wall, a bottom wall, and two side walls.

One or more shelves 15 may be secured to the walls 13 within the fresh food compartment 12. One or more storage bins, storage baskets, storage receptacles, or drawers 17 may be slidably secured to the shelves 15, the walls 13, or the cabinet 11 within the fresh food compartment 12. More specifically, the drawers 17 may be slidably secured to the shelves 15 or the walls 13 within the fresh food compartment 12 via tracks or rails. One or more of the drawers 17 may be either a pantry drawer 19 or a crisper drawer 21. Crisper drawer 21 may more specifically be drawers defining a storage space that is kept at a desired humidity that may be different from the remainder of the fresh food compartment 12, but that is optimal for maintaining freshness of fruits and vegetables.

The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food compartment 12 when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

One or more storage bins, storage baskets, drawers, or storage receptacles 26 may be disposed within the freezer compartment 14. Alternatively, the one or more storage receptacles 26 may be disposed within the fresh food compartment 12. The one or more storage receptacles 26 may have an open top. The one or more storage receptacles 26 may be slidably secured to the cabinet 11 or the internal walls (e.g., walls 13) within the freezer compartment 14 or alternatively within the fresh food compartment 12. More specifically, the one or more storage receptacles 26 may be secured to the internal walls via guides 28 (e.g., linear guides, guide rails, rails, etc.) such that the one or more storage receptacles 26 may slide forward and rearward relative to the refrigerator 10. The one or more storage receptacles 26 may slide forward and rearward relative to the refrigerator 10 independent from or in conjunction with the door 18.

Referring to FIGS. 3-7, a storage bin 30 that is disposed within one of the compartments of the refrigerator (e.g., the fresh food compartment 12 or the freezer compartment 14) is illustrated. The storage bin 30 may correspond to one of the storage bins, storage baskets, storage receptacles, or drawers 17 depicted in FIG. 1 or to one of the storage bins, storage baskets, drawers, or storage receptacles 26 depicted in FIGS. 1 and 2. The storage bin 30 defines a storage space 32. More specifically, the storage bin 30 includes a plurality of walls 34 defining the storage space 32. The plurality of walls 34 may include a front wall 36, a rear wall 38, opposing side walls 40, and a bottom wall 42. A trim component 44 may be secured to a topside of the front wall 36.

The storage bin 30 includes overhanging regions 46 extending laterally outward (e.g., outward from the storage bin 30 along direction 48) from lateral sides 50 (e.g., along the side walls 40) of the storage bin 30, along a top region or top 52 of the storage bin 30, and along a front region or front 54 of the storage bin 30. The storage bin 30 also defines spaces 56 between the lateral sides 50 (e.g., side walls 40) and the overhanging regions 46. The storage bin 30 is movably (e.g., slidably) secured to the cabinet 11, or more specifically walls 13, within an internal cavity defined by the cabinet 11 (e.g., the freezer compartment 14 or the fresh food compartment 12) via the guides 28 such that the storage bin 30 is movable into and out of the internal cavity via the guides 28. The guides 28 may be disposed on the opposing side walls 40 of the bin 30 and may be secured to the opposing side walls 40 of the bin 30.

The guides 28 may each have a first rail 58 and a second rail 60 that are slidably secured to each other. The first rail 58 of each guide 28 may be secured to the cabinet 11, or more specifically to the walls 13. More specifically, the first rail 58 of each guide 28 may be secured to the cabinet 11 such that each first rail 58 is affixed to the cabinet 11 and such that relative movement between each first rail 58 and the cabinet 11 is restricted or prohibited. Each first rail 58 may more specifically be secured to an adapter 62, where each adapter 62 is in turn secured to the cabinet 11, or more specifically to walls 13. Each adapter 62 may be affixed to the cabinet 11 and one of the first rails 58 such that relative movement between each first rail 58, each adapter 62, and the cabinet 11 is restricted or prohibited. Each of the adapters 62 is also operable to conceal at least a portion of one of the guides 28, which may be aesthetically pleasing to a consumer.

The storage bin 30 includes cover or more specifically guide covers 64. The guide covers 64 are also each operable to conceal at least a portion of one of the guides 28. The guide covers 64 are each disposed within one of the spaces 56 defined between the lateral sides 50 (e.g., side walls 40) and the overhanging regions 46 such that the guide covers 64 are concealed by the overhanging regions 46, which may be aesthetically pleasing to a consumer. Each of the guide covers 64 are each secured to an internal side 66 of one of the overhanging regions 46 along the front 54 of storage bin 30. Each of the guide covers 64 are secured to one the guides 28 such that the storage bin 30 is secured to the guides 28 via the guide covers 64. More specifically, each of the guide covers 64 may be affixed to the storage bin 30 and to one of the second rails 60 such that relative movement between the guide covers 64, each second rail 60, and the storage bin 30 is restricted or prohibited. Therefore, the storage bins 30 are operably movable (e.g., slidable) into and out of the internal cavity via relative movement between the first rails 58 and the second rails 60. Furthermore, since the guide covers 64 are operable to secure the storage bin to the guides 28, the guide covers 64 may be referred to as adapters or adapter plates.

The guide covers 64 may further include protrusions 68 extending laterally inward therefrom (e.g., inward and toward the lateral sides 50 or the side walls 40 along direction 48). The protrusions 68 engage or are operable to engage the storage bin 30 along the lateral sides 50 (e.g., along the side walls 40) to restrict lateral movement of the storage bin 30 and to center the storage bin 30 between the adapters 62. Such centering of the storage 30 between the adapters 62 also operates to position the storage bin 30 between the adapters 62 such that gaps 70 defined between the adapters 62 and the overhanging regions 46 maintains a constant dimension 72 (e.g., a width) between a top and bottom of the gaps 70, which may be aesthetically pleasing to a consumer.

The protrusions 68 extend laterally inward (e.g., inward and toward the lateral sides 50 or the side walls 40 along direction 48) from the guide covers 64 via biasing elements 74 (e.g., springs such as leaf springs). The biasing elements 74 are operable to bias the protrusions 68 toward the lateral sides 50 (e.g., the side walls 40) of the storage bin 30. The protrusions 68 may be in the form of ribs, which may be oriented horizontally. Support gussets 76 may extend between the protrusions 68 and the biasing elements 74 to provide additional strength or structural integrity along the connection between the protrusions 68 and the biasing elements 74.

The protrusions 68 engage the storage bin 30, or more specifically engage the lateral sides 50 (e.g., the side walls 40) of the storage bin 30, via an interference engagement such that the protrusions 68 and biasing elements 74 are deflected laterally outward (e.g., outward and away from the lateral sides 50 of the storage bin 30 along direction 48) and such that the biasing elements 74 apply forces to the storage bin 30, or more specifically apply forces to the lateral sides 50 (e.g., the side walls 40) of the storage bin 30, via the protrusion 68. Such forces applied to the storage bin 30 by the biasing elements 74 via the protrusions 68 may be directed inward and toward the lateral sides 50 or the side walls 40 along direction 48.

The guide covers 64 further include clips 78. Each clip 78 engages the internal side 66 of one of the overhanging regions 46 along the front 54 of storage bin 30 to secure the guide covers 64 to the storage bin 30. More specifically, the storage bin 30 further comprising ledges 80 protruding into the spaces 56 defined between the lateral sides 50 and the overhanging regions 46, along the internal sides 66 the overhanging regions 46, and along the front 54 of the storage bin 30. Each clip 78 engages one of the ledges 80 to secure the guide covers 64 to the storage bin 30.

It is noted that the positioning of the clips 78 and the ledges 80 is along the front 54 of the storage bin 30.

However, the clips 78 and ledges 80 are also disposed within the spaces 56, which are behind the overhanging regions 46 of the storage bin 30 when viewing the storage bin 30 from an external point of view along the top 52 or along the front 54 of the storage bin 30. Therefore, although the clips 78 and the ledges 80 are positioned along the front 54 of the storage bin 30, the clips 78 and ledges 80 are also hidden behind the overhanging regions 46 along the front 54 of the storage bin 30 such that the clips 78 and ledges 80 are not visible externally along the front 54 of the storage bin 30.

Each clip 78 may define a notch 82 along a lower region of each clip 78. A bridging element or bridge 84 may span a front portion of the notch 82 to create an opening that is closed along an outer periphery that includes an outer periphery of the notch and the bridge 84. The storage bin 30 further includes tabs 86 protruding upward from the ledges 80. The tabs 86 engage the clips 78 within the notches 82 to secure the guide covers 64 to the storage bin 30. The bridge 84 operates to maintain engagement between the tabs 86 and the clips 78, and hence ultimately operates to secure the guide covers 64 to the storage bin 30. A tool (e.g., punch or screwdriver) may be utilized to engage the tabs 86 in order to release the engagement between the tabs 86 and the clips 78 if removal of the guide covers 64 from the storage bin 30 is desired (e.g., during a maintenance operation).

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet defining an internal cavity;

a storage bin (i) disposed within the internal cavity, (ii) having side walls, (iii) having overhanging regions extending laterally outward from the side walls along a top and a front of the storage bin, and (iv) defining spaces between the side walls and the overhanging regions;

guides each having first and second rails slidably secured to each other, wherein the first rail of each of the guides is secured to the cabinet; and guide covers each (i) operable to conceal one of the guides, (ii) disposed within one of the spaces such that the guide covers are concealed by the overhanging regions, (iii) secured to an internal side of one of the overhanging regions along the front of the storage bin, and (iv) secured to one of the second rails such that the storage bin is (a) secured to each of the second rails via the guide covers and (b) operably slidable into and out of the internal cavity via relative movement between the first and second rails, wherein the guide covers include clips, each of the clips engages the internal side of one of the overhanging regions along the front of the storage bin to further secure the guide covers to the storage bin, the storage bin further comprises ledges protruding into the spaces along the internal sides of the overhanging regions and along the front of the storage bin, each of the clips engages one of the ledges to further secure the guide covers to the storage bin, the storage bin further comprises tabs protruding upward from the ledges, the clips define notches, and the tabs engage the clips within the notches to further secure the guide covers to the storage bin.

2. The refrigerator appliance of claim 1, wherein the guide covers include protrusions extending laterally inward therefrom, and wherein the protrusions engage the side walls of the storage bin to restrict lateral movement of the storage bin.

3. The refrigerator appliance of claim 2, wherein the protrusions extend laterally inward from the guide covers via biasing elements, and wherein the biasing elements are operable to bias the protrusions toward the side walls of the storage bin.

4. The refrigerator appliance of claim 3, wherein the protrusions engage the side walls of the storage bin via an interference engagement such that (i) the protrusions and biasing elements are deflected laterally outward and (ii) the biasing elements apply a force to the side walls via the protrusions.

5. The refrigerator appliance of claim 3 further comprising support gussets extending between the protrusions and the biasing elements.

6. A refrigerator appliance comprising:

a cabinet defining an internal cavity;

a storage bin disposed within the internal cavity;

a guide movably securing the storage bin to the cabinet such that the storage bin is movable into and out of the internal cavity via the guide; and a cover (i) operable to conceal the guide, (ii) secured to the storage bin, (iii) secured to the guide such that the storage bin is secured to the guide via the cover, and (iv) having a protrusion extending laterally inward therefrom via a biasing element, wherein the protrusion engages the storage bin to restrict lateral movement of the storage bin, and wherein the biasing element is operable to bias the protrusion toward the storage bin.

7. The refrigerator appliance of claim 6, wherein the protrusion engages the storage bin via an interference engagement such that (i) the protrusion and biasing element are deflected laterally outward and (ii) the biasing element applies a force to the storage bin via the protrusion.

8. The refrigerator appliance of claim 6, wherein the storage bin (i) has a lateral side, (ii) an overhanging region extending laterally outward from the lateral side along a top and a front of the storage bin, and (iii) defines a space between the lateral side and the overhanging region, and wherein the cover is disposed within the space such that the cover is concealed by the overhanging region.

9. The refrigerator appliance of claim 8, wherein the cover is secured to an internal side of the overhanging region along the front of the storage bin.

10. The refrigerator appliance of claim 9, wherein the cover includes a clip, and wherein the clip engages the internal side of the overhanging region along the front of the storage bin to further secure the cover to the storage bin.

11. The refrigerator appliance of claim 10, wherein the storage bin further comprises a ledge protruding into the space along the internal side of the overhanging region and along the front of the storage bin, and wherein the clip engages the ledge to further secure the cover to the storage bin.

12. The refrigerator appliance of claim 11, wherein the storage bin further comprises a tab protruding upward from the ledge, wherein the clip defines a notch, and wherein the tab engages the clip within the notch to further secure the cover to the storage bin.

13. The refrigerator appliance of claim 6 further comprising a support gusset extending between the protrusion and the biasing element.

14. A refrigerator appliance comprising:

a cabinet defining an internal cavity;

a storage bin (i) disposed within the internal cavity, (ii) having an overhanging region extending laterally outward from a lateral side of the storage bin along a top and a front of the storage bin, and (iii) defining a space between the lateral side and the overhanging region;

a guide rail movably securing the storage bin to the cabinet such that the storage bin is movable into the internal cavity via the guide rail; and an adapter plate (i) disposed within the space such that the adapter plate is concealed by the overhanging region, (ii) secured to an internal side of the overhanging region, and (iii) secured to the guide rail such that the storage bin is secured to the guide rail via the adapter plate, wherein the adapter plate has a protrusion (a) extending laterally inward therefrom via a biasing element and (b) engaging the storage bin to restrict lateral movement of the storage bin, and wherein the biasing element is operable to bias the protrusion toward the storage bin.

15. The refrigerator appliance of claim 14, wherein the protrusion engages the storage bin via an interference engagement such that (i) the protrusion and biasing element are deflected laterally outward and (ii) the biasing element applies a force to the storage bin via the protrusion.

16. The refrigerator appliance of claim 14, wherein the adapter plate includes a clip, and wherein the clip engages the internal side of the overhanging region along the front of the storage bin to further secure the adapter plate to the storage bin.

17. The refrigerator appliance of claim 16, wherein the storage bin further comprises a ledge protruding into the space along the internal side of the overhanging region and along the front of the storage bin, and wherein the clip engages the ledge to further secure the adapter plate to the storage bin.

18. The refrigerator appliance of claim 17, wherein the storage bin further comprises a tab protruding upward from the ledge.

19. The refrigerator appliance of claim 18, wherein the clip defines a notch, and wherein the tab engages the clip within the notch to further secure the adapter plate to the storage bin.

20. The refrigerator appliance of claim 14 further comprising a support gusset extending between the protrusion and the biasing element.

* * * * *